US006141029A

United States Patent [19]

Günther et al.

[11] Patent Number: 6,141,029

[45] **Date of Patent: *Oct. 31, 2000**

[54] METHOD AND THERMAL PRINTING APPARATUS FOR IDENTIFYING AN END OF AN INKING RIBBON

[75] Inventors: Stephan Günther; Wolfgang Thiel, both of Berlin, Germany

[73] Assignee: Francotypo-Postalia AG & Co., Birkenwerder, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/298,562

[22] Filed: Apr. 22, 1999

Related U.S. Application Data

[63] Continuation of application No. 08/609,790, Mar. 1, 1996, Pat. No. 5,821,975.

[30] Foreign Application Priority Data

Mar. 7, 1995 [DE] Germany ..... 195 09 683

[51] Int. Cl.[7] ..... B41J 35/36; B41J 17/36

[52] U.S. Cl. ..... 347/217; 400/249

[58] Field of Search ..... 347/217; 400/249

[56] References Cited

U.S. PATENT DOCUMENTS

| | | | |
|---|---|---|---|
| 4,456,392 | 6/1984 | Nozaki et al. . | |
| 4,491,430 | 1/1985 | Kuelzer . | |
| 4,494,886 | 1/1985 | Kondo et al. . | |
| 4,586,834 | 5/1986 | Hachisuga et al. . | |
| 4,590,486 | 5/1986 | Yana . | |
| 4,641,149 | 2/1987 | Suzaki et al. . | |
| 4,733,251 | 3/1988 | Murakami et al. . | |
| 4,746,234 | 5/1988 | Harry . | |
| 4,907,902 | 3/1990 | Doi . | |
| 4,924,240 | 5/1990 | Herbert et al. . | |
| 4,984,913 | 1/1991 | Silvermann et al. | 400/249 |
| 5,344,244 | 9/1994 | Fukahori et al. . | |
| 5,365,312 | 11/1994 | Hillmann et al. | 400/249 |
| 5,414,449 | 5/1995 | Buan et al. . | |

FOREIGN PATENT DOCUMENTS

| | | |
|---|---|---|
| 0 189 268 | 12/1989 | European Pat. Off. . |
| 0 504 594 | 9/1992 | European Pat. Off. . |
| 0 546 944 | 6/1993 | European Pat. Off. . |
| 0 550 227 | 7/1993 | European Pat. Off. . |
| 86 13 965 U | 9/1986 | Germany . |
| 42 25 798 | 2/1994 | Germany . |
| 62-288977 | 11/1989 | Japan . |
| 63-32823 | 7/1990 | Japan . |

*Primary Examiner*—Huan Tran
*Attorney, Agent, or Firm*—Schiff Hardin & Waite

[57] ABSTRACT

A thermal transfer printer has a thermal print head with a number of thermal print elements which are operated by power electronics and controlled by a control unit to print an imprint on a medium by thermally transferring ink from an inking ribbon to the medium by energization of selected print elements by the control unit, with the inking ribbon and the medium being movably disposed between the print head and a counter-roller with the inking ribbon being unwound from a supply reel and wound onto a take-up reel. The end of the inking ribbon is identified in a method and apparatus wherein the number of imprints produced by said inking ribbon is counted, and a signal is emitted after a predetermined number of said imprints has been counted.

2 Claims, 4 Drawing Sheets

METHOD AND THERMAL PRINTING APPARATUS FOR IDENTIFYING AN END OF AN INKING RIBBON

The present application is a continuation application of U.S. application Ser. No. 08/609,790, filed Mar. 1, 1996 now U.S. Pat. No. 5,821,975 (Günther et al., "Method and Apparatus for Preventing Usage of an Unauthorized Inking Ribbon in a Thermal Printing process") assigned to the same Assignee, Francotyp-Postalia AG & Co., as the present application.

BACKGROUND OF THE INVENTION

1. Field of the Invention

The present invention is directed to a method and apparatus for preventing usage of an unauthorized inking ribbon in a thermal printing process, i.e., for preventing usage of a ribbon which has not been approved by the manufacturer of a thermal transfer printing device.

2. Related Application

The present application is related in subject matter to an application of the same inventors, and assigned to the same Assignee, Francotyp-Postalia AG & Co., entitled "Method and Apparatus for Monitoring Inking Ribbon Usage in a Thermal Printing Process and for Controlling Printing Dependent Thereon" (P96,0404), filed Mar. 1, 1996 and having Ser. No. 08/609,797 and now issued as U.S. Pat. No. 5,821,975 and the present application therefore contains disclosure directed to that invention as well as the present invention.

DESCRIPTION OF THE PRIOR ART

Thermal printing cassettes generally include a supply reel and a take-up reel which hold and convey an inking ribbon, and a number of deflection rollers for guiding the ribbon. It is necessary to keep the inking ribbon taut in order to achieve a constant printing quality.

European Application 189 268 discloses a receptacle for inking ribbon cassettes. The sidewall of the cassette has an opening through which a roller can pass for seating against the inking ribbon in order to receive the drive force therefrom, or to transmit it onto a friction roller that is coupled to an encoder disk. The speed of the inking ribbon approximately corresponds to that of the printing matter that is conveyed between the inking ribbon and the back-pressure roller.

European Application 504 594 A2 discloses a serpentine ribbon guidance between the print head and take-up reel in order to assure a decoupling of the take-up from forces that can be achieved by friction between the inking ribbon and paper. Practice, however, has shown that the aforementioned serpentine ribbon guidance can be eliminated if the deflection rollers are replaced by non-rotatable deflection pins.

Thermal transfer printing processes are often utilized in situations wherein (for whatever reasons) the relatively expensive, light-sensitive and heat-sensitive direct thermal printing paper must be foregone. The inking ribbons thereby utilized enable printing on normal paper, but their cost also enters directly into the commodity costs of the imprint. German OS 31 45 221 discloses that a relative speed always be maintained between the inking ribbon and recording medium (printing matter), so that the length of inking ribbon required is thereby reduced thereby reducing costs.

99.9% of all impressions contain regions unoccupied by printing otherwise, of course, the informational content would be minimal (i.e., a solid printed block). For example, only about 15% of the available area is printed in the case of franking impressions. 85% of the ink of the inking ribbon thus remains unused.

In summary, it can be said that thermal printing technology has comparatively high commodity costs per printed area and that it is also not especially environmentally sound due to the high proportion of carrier material (given thermal transfer printing).

Known thermal transfer printing processes only use the inking ribbon once. Ink residues remain in the unused regions in every printing cycle. Since these unused regions can no longer be employed for the following printing cycle, an unnecessarily large quantity of wound-up inking ribbon is produced.

U.S. Pat. No. 4,590,486 discloses that the inking ribbon be stopped at voids in the print format in order to save expensive inking ribbon.

The efforts of manufacturers have now been concentrated to developing a re-employable inking ribbon, whereby only a part of the total ink present in the ribbon is fused out of the ribbon by each printing event. As a result of the multiple passes of this ribbon (similar to a known typewriter ribbon), the ink supply is also ultimately exhausted after about 10 prints, and the ribbon is spent.

German OS 37 21 925 discloses a thermal transfer printing process wherein multiple use of the inking ribbon is possible without degrading the printing quality. After the excitation of the printing elements, half of the ink layer is melted from the inking ribbon, while half of the ink layer remains on the inking ribbon under the half that has been melted off when the inking ribbon is separated from the recording medium a predetermined time interval after the excitation of the printing element. The ink layer half still comprising a relatively low viscosity in its melted condition.

Success is yet to be achieved in manufacturing a so-called multi-use ribbon with a (nearly) constant printing quality from the first to the last impression. On the contrary, a considerable loss of contrast that lies on the order of about 50% can already be noted between the first and the second pass of known ribbons. Those regions on the inking ribbon that are repeatedly used lie immediately next to regions that are used only once and therefore produce greater contrast. This is unacceptable for many applications that demand uniformly high printing quality. This is also the reason why these so-called multi-use ribbons have failed to become widely distributed in the marketplace.

The publication JP 62-288977 discloses means for a thermal transfer printing process in order to regenerate a multi-use inking ribbon after one-time use. The multi-use inking ribbon is thereby broader than the print head and has a high-density ink region running above said print head and an ink region with lower density that runs at the level of the print head. Ink is melted onto a recording medium from this lower-density ink region when the aforementioned print head is driven. This consumed ink can be replenished at a following location of the printer arrangement, whereby ink melted from the high-density ink region when heated by a second print head flows into the lower-density ink region due to the force of gravity and capillary action. A roller is arranged, following this second print head at the take-up reel, in order to smooth the surface of the ribbon. Such an arrangement is essentially provided for typewriters, i.e. printers that print line-by-line. Such arrangements are unsuitable for postage meter machines because these print a print column that extends over the entire width of the inking ribbon. Even if the inking ribbon were widened to twice its width, which would make it significantly more expensive, the capillary action would not be supported by the force of gravity when the letter—that is usually conveyed flat—is moved under the print head together with the inking ribbon. The ink melted by a second print head will merely drip onto the letter.

The publication JP 63-328237 discloses heated rollers for a thermal transfer printing process in order to regenerate a multi-use inking ribbon after a one-time use. To this end, however, the roller must be arranged over the multi-use inking ribbon so that the ink does not run off past the roller or onto the halogen lamp used for heating, which would destroy the ribbon. Due to this arrangement, this approach is unsuitable for postage meter machines because it would be difficult to design an appropriate cassette that brings the heated roller into contact with the inking ribbon at a location following the print head.

It is known to utilize a second print head to prevent the use of franking impressions which remain on a used inking ribbon for fraudulent purposes. To avoid this, the franking impression should no longer be legible on the take-up reel, for which reason the ink not required for the printing is printed onto that part of the inking ribbon that has already passed the first print head, in the form of a negative impression by the second print head. Regeneration of the inking ribbon is therefore not possible.

Further, U.S. Pat. No. 4,924,240 discloses that a distance from the printing matter different from the printing position be assumed during interim times wherein no printing matter is conveyed under the print head and that the inking ribbon be partially rewound so that each sub-section of the inking ribbon can be used for some time, i.e. multiply. A disadvantage of this approach, however, is that an electromechanical actuator is required for moving the head from the printing position and an additional motor is required for rewinding the inking ribbon, both having to be actuated relatively often. High printing speeds can thus not be achieved.

German OS 42 25 798 discloses ribbon-saving thermal transfer printing process that operates with a ribbon speed of the inking ribbon that is lower than the conveying speed of the recording medium (saving mode). The method is aimed at an optimum use of the ink residues between the printing columns. The motor that is required for rewinding the inking ribbon and the drive motor for unwinding the inking ribbon are driven according to a complicated method and loaded to different degrees, so that the useful life is shortened and the maximum printing speed is not reached.

U.S. Pat. No. 5,344,244 discloses a thermal color printer that can identify the as yet unused sections of an inking ribbon with a sensor and a microprocessor. A differing consumption of the respective ink sections on the ribbon occurs due to the production of color images with three primary colors that can be printed on top of one another. Unused ink sections always remain on the ribbon and such inking ribbons with alternating ink sections are very expensive. Ink sections which have been used can then be identified by a mark made on the ribbon with a second print head. When the ribbon is used again, the microprocessor determines—with reference to these markings—whether an impression is still possible. A true multiple use of each and every ink section on the ribbon, however, is not possible.

European Application 550 227 discloses a multi-use inking ribbon control that makes us of a magnetic marking on the inking ribbon. The manufacture of such markings is difficult since they must withstand the melting of the ink, i.e. high temperatures. Such markings are therefore possible only at the start or end of the ribbon in order to be able to detect a change of cassette with a Hall effect sensor. How the cassette was inserted can thus be identified by the identified orientation of the magnetization. If the cassette was inserted opposite to the proper way, then the orientation of the magnetization is opposite.

A further disadvantage of all of the aforementioned solutions is that they do not provide protection against imitations, known as pirated products and that are offered cheaper. Little value is attached to the printing quality in such imitations. High print quality, however, is a requirement in certain applications. It has been documented that original cassettes have been refilled, not by the manufacturer but by third parties, with poor quality, cheap ribbon material. A noticeable print quality deterioration the occurs that causes illegible impressions that, for example, cannot be accepted by postal authorities for franking imprints, especially in the case of multi-use inking ribbon cassettes.

SUMMARY OF THE INVENTION

It is an object of the present invention to provide a method and apparatus wherein usage of an unauthorized inking ribbon in a thermal printing process is prevented, i.e., usage of a ribbon which has not been previously approved by a manufacturer of a thermal printing apparatus is automatically prevented upon an attempt to make use of such an unauthorized ribbon.

It is a further object of the present invention which permits an authorization code on an approved ribbon to be periodically or selectively changed.

The method and apparatus of the invention are employed in a thermal transfer printer with a thermal print head that having a plurality of print elements is connected via power electronics and via a print controller to a microprocessor in a control unit. A counter-pressure means presses the recording medium against an inking ribbon, which is wound from a first reel onto a second reel and which is supported against the thermal print head. A roller is preferably utilized as the counter-pressure means and a microprocessor control as disclosed in detail in, for example, U.S. Pat. No. 4,746,234 is employed.

It is inventively provided that the inking ribbon is fashioned for the recognition of markings for control conditions (usage history and/or authorization), the authorization marking enabling an authentication of the inking ribbon material in the control unit containing a microprocessor and non-volatile memory. At least one valid reference code is stored in the aforementioned non-volatile memory. At least one first recognition unit is arranged at the inking ribbon cassette, which supplies at least one first signal identifying the status of the inking ribbon on the allocated supply reel, including at least the validity of the inking ribbon material or the type of inking ribbon, to the microprocessor of the control unit before the end of the inking ribbon is reached. The microprocessor is programmed to compare the stored reference code to the detected status information and to authorize the inking ribbon given coincidence, whereby printing is prevented given non-coincidence. The codes can be modified with the assistance of the microprocessor.

In an embodiment the inking ribbon is a multi-use inking ribbon with an optically readable inking ribbon marking applied by the manufacturer.

For recognizing control conditions about the wear of the inking ribbon and the validity of the inking ribbon, the multi-use inking ribbon is provided with a readable code, preferably a bar code, that is modified by the microprocessor after an expiration time or periodically.

The first recognition unit is preferably an optical recognition unit that supplies the signal about the validity of the inking ribbon for printing and/or about the quantity of inking ribbon remaining on the allocated reel before the end of the inking ribbon is reached. The inking ribbon is provided with an applied marking that can be optically read by the recognition unit.

The thermal printing head can be used to mark the inking ribbon arranged in a cassette with a predetermined print pattern in order to generate the optical marking that is detected by the first optical recognition unit.

Means that emit heat are arranged following the print head at the window of the cassette in the proximity of the deflection roller, and the microprocessor of the controller is programmed to drive the heat-emitting means such to contribute to the formation of a marking.

The heat-emitting means can be a linolite lamp suitable for intensified heat emission that melts the uppermost layer column-by-column and a following roller with which the inking ribbon is ironed smooth so that the ink is approximately uniformly distributed when a franking impression is applied, and which is pivoted away from the inking ribbon when a marking is printed.

The heat-emitting means can be a second counter-pressure roller or a receptor drum and a second print head that is arranged at a relatively small distance from the first print head and aligned in the ribbon-conveying direction. For generating a negative impression on the second counter-pressure roller or, respectively, receptor drum, the microprocessor calculates a time delay of the drive of the second print head that corresponds to the spacing.

Based on the fact that the contrast produced in thermal transfer printing is directly dependent on the printing energy being applied, a control of the printing energy of the thermal transfer printing is inventively undertaken dependent on the quality of the existing multi-use inking ribbon. The quantity of ink present in the multi-use inking ribbon is thereby linearly dependent on the plurality of uses.

A first optical or mechanical recognition unit is arranged at the print head which supplies a signal identifying the quantity of inking ribbon remaining on the allocated reel before the end of the inking ribbon is reached. The end of the inking ribbon is recognized, for example, by detecting a second optical recognition mark, or the encoder disk stops turning or the number of impressions is counted by the processor. The signal is communicated to the control unit.

The cassette housing inventively has at least one electronic, magnetic, optical and/or mechanical memory. Stored information relates to the multi-use states (MUS). How often this inking ribbon direction was already used proceeds therefrom. Other stored information, ribbon movement direction (RMD), relates to the current arrangement status assumed by the printer housing in accord with the direction of inking ribbon movement, i.e. a cassette reverse or not.

A second recognition unit alternatively be a mechanical recognition unit that, before the end of the inking ribbon is reached, supplies a signal about the quantity of inking ribbon remaining on the allocated reel that is stored in a mechanical memory of the cassette. When the end of the inking ribbon is reached, this effects a modification of the information status of the memory of the cassette housing. This status change is sensed after the removal and re-insertion into the old or new, reversed position of the cassette housing, in order to read the information and communicate it to the control unit. A recognition unit arranged in the machine engages the printer housing and supplies a signal about the direction of ribbon movement. This information is communicated to the control unit.

An inventive thermal transfer printing process is employed with a thermal print head having a number of print elements and that is connected via power electronics and via a print controller to a microprocessor and memory, with a counter-pressure device and an inking ribbon cassette, the inking ribbon being wound from a first reel onto a second reel. Control by the microprocessor inventively ensues in the following steps: Reference information is entered into the non-volatile memory of the control unit. Ribbon feed ensues after insertion of the cassette and scanning of the inking ribbon. Information at the start of the inking ribbon is identified from an applied marking on the ribbon which is compared to the aforementioned reference information. The type of inking ribbon or the validity thereof is signaled via a display after the insertion and initialization of the cassette. The printing energy is enabled according to the valid or the printing energy given invalidity of the applied marking. Ribbon feed ensues up to the end of the inking ribbon according to the actuated impressions. The approaching ribbon end is identified by acquiring a corresponding marking of the inking ribbon before the inking ribbon is used up.

The inventive thermal transfer printing method inventively differs from known technological solutions at least on the basis of the changing of the authentication or authorization code periodically or at time intervals.

DESCRIPTION OF THE PREFERRED EMBODIMENTS

Figure 1A:
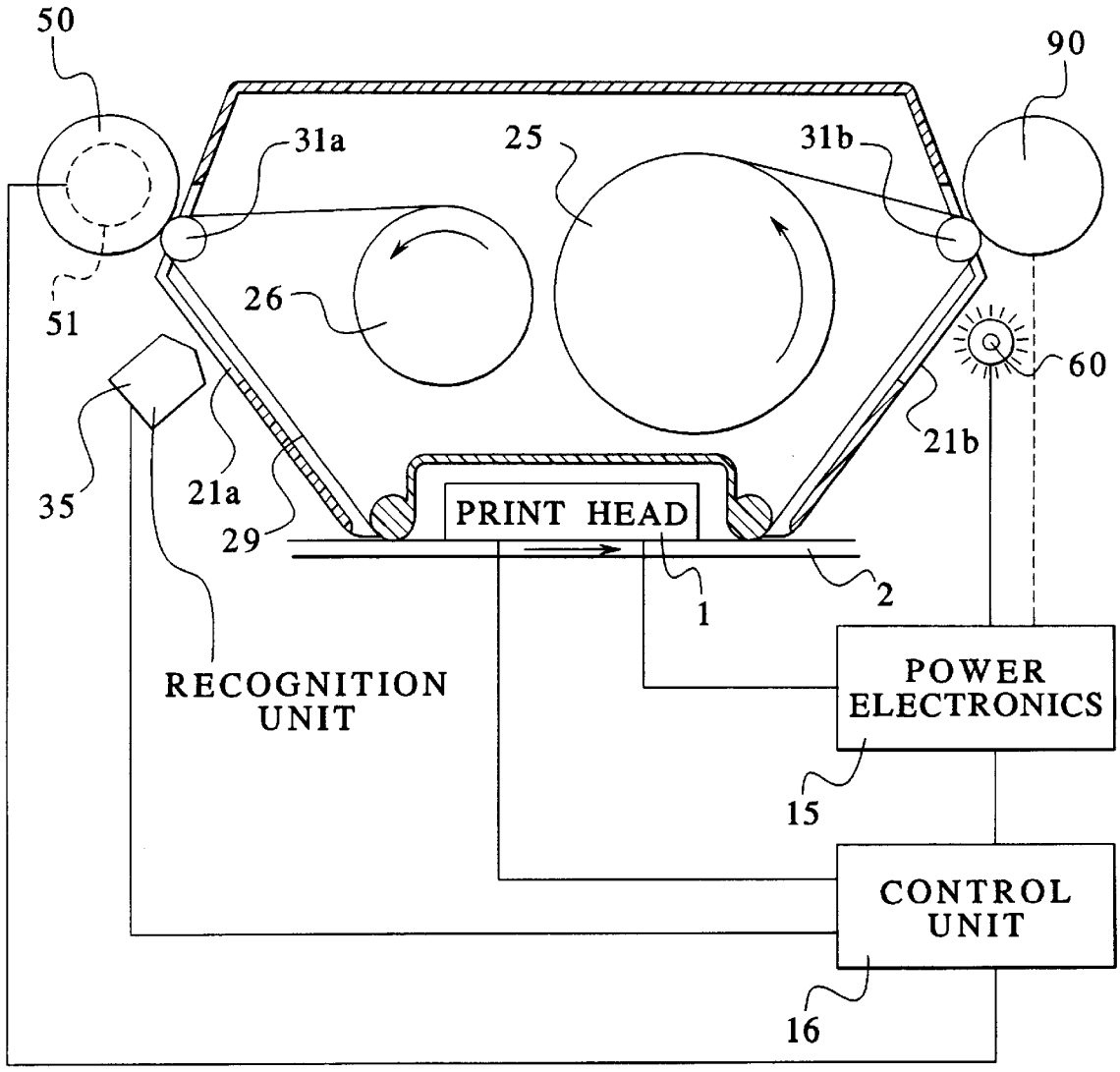
FIG. 1*a* illustrates the arrangement of an inventive inking ribbon cassette in a thermal transfer printer.

A thermal transfer or ETR printer head 1 with an associated print controller 14 and power electronics 15 can, for example, be employed in a thermal transfer printer. The aforementioned components of the thermal transfer printer are usually controlled by an intelligent control means, for example by a control unit 16 containing a microprocessor $\mu$P. The inking ribbon 29 is unwound from a reel 26 and is wound onto a reel 25. The inking ribbon thereby runs from the reel 26 between print head 1 and a recording medium 2 to the reel 25. The recording medium 2 is pressed against the inking ribbon 29 in a standard way with a counter-pressure roller (not shown). Such an arrangement is disclosed by U.S. Pat. No. 4,746,234.

Figure 1B:
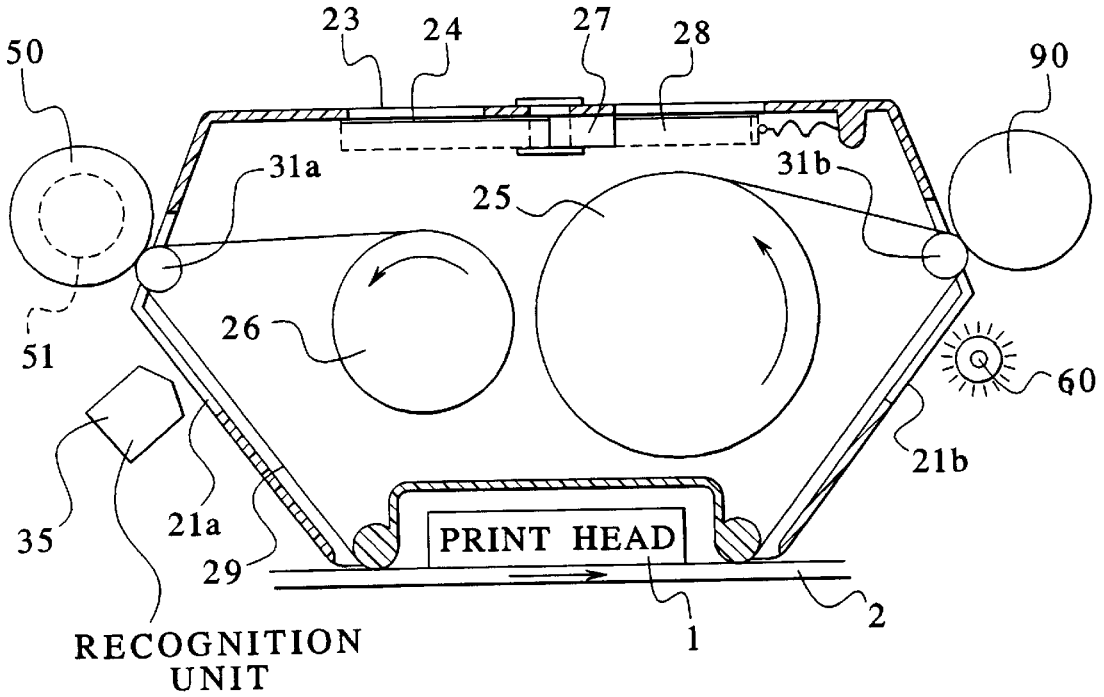
FIGS. 1*b*–1*d*, respectively illustrate further versions of inventive with multi-use inking ribbon cassettes.
Figure 1C:
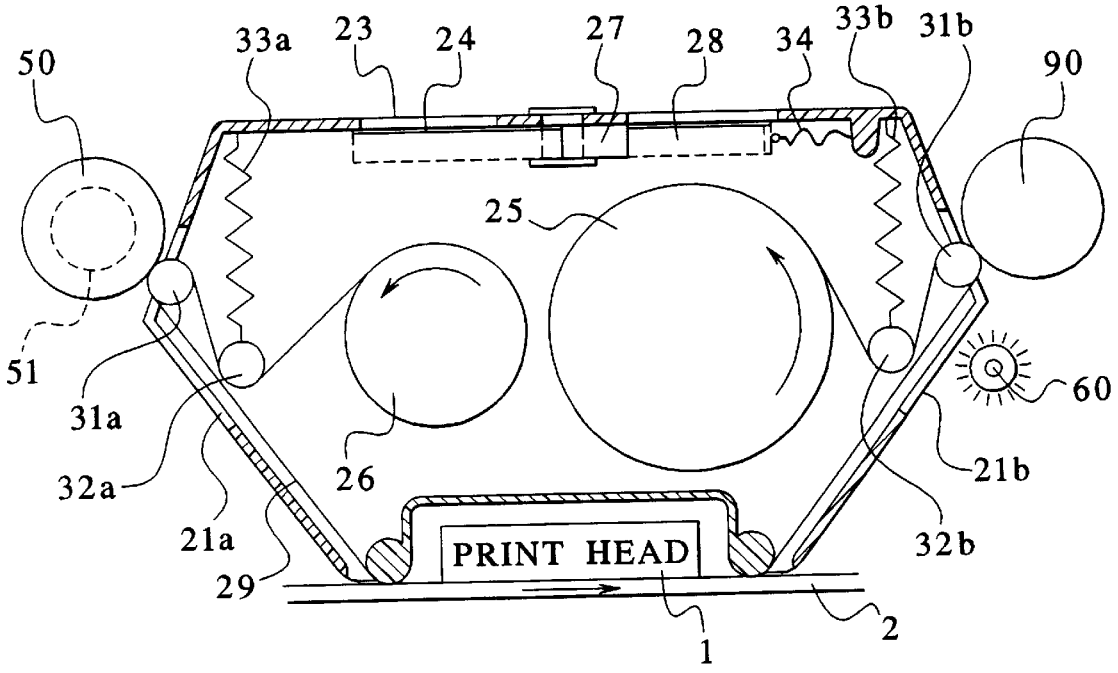
Figure 1D:
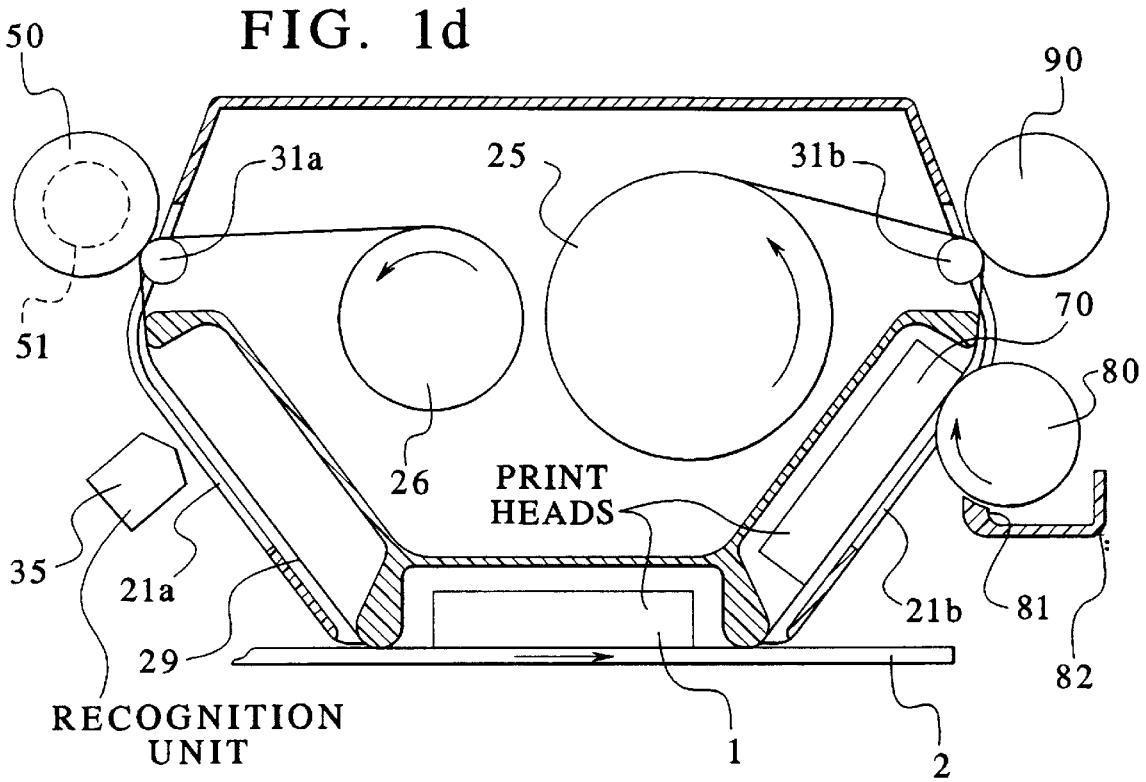

The control unit 16 and the power electronics 15 and their connections to other components are only shown in FIG. 1*a*, but are present in each of FIGS. 1*b*–1*d* as well.

The inventive arrangement and inking ribbon cassette—shown in FIG. 1*a*—for a thermal transfer printing process uses only the inking ribbon 29 as memory means for authenticity and/or usage history information. A first information symbol ("symbol" being used in the broad sense of any type of information conveying configuration) relates to piracy protection and is applied during manufacture to at least the start of each inking ribbon of a cassette protected in this way. Such an information symbol is applied as a printed marking, for example in the form of a bar code, and can be sensed by a first recognition unit (reader) 35 given a newly introduced cassette. This first recognition unit 35 is arranged following a turning roller 31*a* and before the print head 1 so as to have a field view through window 2 in the cassette housing near the path of travel of the inking ribbon 29. The recognition unit 35 communicates at least the type of inking ribbon to the microprocessor of the control unit 16.

A reflected light sensor or a commercially obtainable scanner can be utilized as the first recognition unit 35 in order to read the bar code. Such a printed marking can be applied to the ribbon 29 at regular intervals. When the complete inking ribbon 29 has been unwound through the cassette for the first time, an end of ribbon information symbol at the end of the inking ribbon 29 is supplied to the microprocessor by the first recognition unit 35. A final impression before changing the cassette is still possible with the remaining amount of unwound inking ribbon 29.

The aforementioned, detected symbol (such as the bar code) is compared to a reference code that is stored non-volatilely in a memory of or accessible by the microprocessor of the control unit 16. Such a reference code can, for example, be supplied to the microprocessor by a remote data center and its recognition authorizes inking ribbons of the manufacturer with the same bar code to be used for printing for a predetermined time span. Otherwise, the thermal transfer printer of, for example, a postage meter machine is inhibited. This also prevents lightly inked ribbons of the manufacturer, which would merely contribute to a poorer printing quality, from being used. Two or more codes can also be recognized as valid for a transition time. To this end, it is necessary to store a plurality of codes non-volatilely, each being valid for a different or overlapping time period.

A multi-use inking ribbon cassette is employed in the preferred, second version. The multi-use inking ribbon has memory means for aforementioned first information symbol for piracy protection and for a second information symbol relating to the multi-use status.

FIG. 1*d* shows the arrangement of such a multi-use inking ribbon cassette in a thermal transfer printer means. The inking ribbon 29 is unwound from a reel 29 and wound onto a reel 25. The inking ribbon thereby runs from the reel 26 over the roller 31*a*, then between the print head 1 and the recording medium 2, subsequently over a second print head 70 and then around the roller 31*b* to the reel 25. The recording medium 2 is pressed against the inking ribbon 29 with a counter-pressure roller (not shown). Beginning with the first marking, the number of impressions is supplied to the microprocessor from a reader 51 which monitors rotation of an encoded disk 50 which is rotated by the passage of the inking ribbon 29 through a nip formed with the roller 31*a*. The approach of the end of the inking ribbon can thus likewise be detected. Additionally, a printed end-of ribbon information symbol can be identified by the recognition unit 35, which then emits a signal to the microprocessor.

After a predetermined number of impressions, the microprocessor causes at least one further marking, for example in the form of a bar code, to be applied to the ribbon 29 with the first print head 1. This further marking includes at least the aforementioned first information symbol for piracy protection. Further, the aforementioned marking can include a second information symbol directed to the multi-use status, or a further marking that contains the second information relating to the multi-use status can be additionally applied.

After a predetermined number impressions, selected such that only little inking ribbon still remains on the supply reel 26 of the cassette, the microprocessor caused a marking to be applied with the print head 1 that is deepened (reinforced) with the second print head 70. The microprocessor drives the second print head 70 to print with a time offset relative to the first print head 1. A dual print drive method can be used as disclosed in German OS 42 27 596 modified with respect to the greater spacing between the two print heads.

The end of the inking ribbon can be additionally detected by the microprocessor via the reader 51 in that the encoded disk 50 no longer turns. The microprocessor signals the end of the inking ribbon with a beeper. An instruction that the cassette is to be changed now appears in a display of the printer. After removal, the multi-use inking ribbon cassette is reversed and then re-inserted.

Inventively, a marking at a distance from the end of the inking ribbon such that one impression can still be carried out is then applied on the inking ribbon at the end of the inking ribbon is this second version. For generating such a marking, the first print head 1 is driven by the microprocessor via the power electronics. The ink melts from the inking ribbon and drips onto the counter-pressure roller. The material of the counter-pressure roller does not accept the ink drops but repels them. A doctor or scraper blade (not shown) additionally can be arranged at the counter-pressure roller. A bar code can be advantageously used as printed marking, this being deepened by the second print head 70 operated time offset relative to the first print head 1. The ink continues to melt from the inking ribbon 29 and drips onto a counter-pressure roller 80. The material of the counter-pressure roller 80 does not accept the ink drops but repels them. A blade 81 can be additionally arranged at an ink collecting vessel 82 of the counter-pressure roller 80.

After the implementation of the aforementioned final impression, the inking ribbon 29 runs to its end, controlled by the microprocessor. The recording medium 2 is thereby conveyed away from the print head 1. The marking travels to the second deflection roller 31*b* before the inking ribbon 29 is stopped.

The cassette is reversed when the complete inking ribbon 29 has run through the cassette for the first time. The inking ribbon 29 is then unwound from the reel 25 and is rewound onto the reel 26. After this change, i.e. with the cassette reversed, the marking can then be sensed by the first recognition means 35. At the start of the new pass of the inking ribbon 29, thus, a first recognition means 35 arranged in the proximity of a first window 21*b* with the second deflection roller 31*a* (or, respectively, window 21*a* and deflection roller 31*a* with the cassette turned over again) supplies an information to the microprocessor.

The invention enables the code for the first or second information symbols to be changed. A change of the code for the first information symbol when changing the multi-use inking ribbon cassette improves the piracy protection. Of course, the modified code must be stored non-volatilely again as a reference code in the memory of the microprocessor controller. A change of the code for the second information symbol when changing the multi-use inking ribbon cassette is already required because the wear of the multi-use inking ribbon is to be recognized on the basis of the number of changes that have occurred.

The print head is charged with a required or customized print pattern after every reversal of the multi-use inking ribbon cassette. Given approximately 15% through 20% area use per impression and up to five ink layers on the inking ribbon, only a small portion of the ink is consumed per impression. It is possible to redistribute the ink of the uppermost layer from unused or less used areas to the more highly used areas by an ink redistribution means formed by the roller 80, the second thermal transfer printing head 70, suitable for intensified emission of a heat pattern that melts the uppermost layer, and a following roller 90 which "irons" the surface of the inking ribbon smooth so that the ink is approximately uniformly distributed. It is also possible to heat the roller 90 (this option being indicated by the dashed line from the power electronics 15).

The second thermal transfer printing head 70 is structurally identical to the first thermal transfer printing head 1 and mechanically follows downstream therefrom in the ribbon-travel direction. This second thermal transfer printing head 70 is supplied with the inverse print data, which controlled the preceding impression by the first head 1, time-delayed and thereby a "negative" of the impression made by the first head 1 is produced on the inking ribbon 29 thus those ink particles are released from the inking ribbon that were not released in the original print. A time delay of the drive is calculated by the microprocessor and a corresponding drive procedure can basically be implemented in the way disclosed by German OS 42 27 596. Differing from German OS 42 27 596, the alignment of the two print heads along the ribbon conveying direction is the same and the spacing between the print heads is larger.

This "negative impression" again occurs on an entrained receptor drum 80 that is cleaned of excess ink particles by a mechanical scraper blade 81 at each revolution. These excess ink particles are collected in a collecting vessel 82 and are recyclable as ink material (under certain circumstances).

What is thus achieved is that the entire inking ribbon coat has a defined, uniform quality after every pass and the above-described method for controlling the printing energy can be utilized.

The required components for the inventive method and apparatus (second print head, receptor drum, detection units) constitute a one-time cost, embodied in the price of each device, whereas a considerable cost-saving is achieved with every impression by using the multi-use inking ribbon. A fast amortization of the one-time expenditure is thereby assured.

In order to assure a faultless recognition of the current quality of the inking ribbon during the printing process, the inking ribbon is provided with a marking that makes it possible to optically detect the wear of the inking ribbon and, consequently, to automatically control the printing energy with a final control element such that ink quantities of approximately the same volume given the same printing patterns are melted off at every use of the ribbon. Of course, other types of identification and detection are also conceivable for marking the usage history, for instance magnetic, mechanical or chemical marker.

It is assured in this way that a correspondingly increasing printing energy is applied with increasing "wear" of the inking ribbon (i.e. with a decreasing quantity of ink), with the result that the quantity of ink released per printing event remains nearly constant, and thus a uniformly good imprint quality is assured.

Further, the detection of the inking ribbon quality can also be used in order to define a maximum number of inking ribbon passes that cannot be exceeded in order to assure a minimally required print quality. When the maximum value is reached, for example with five complete passes of the ribbon 29, imprinting (following the detection) is refused by the control unit 16, with the display of an error message.

As noted above, thermal transfer printers are usually controlled by intelligent control means (such as microprocessors). This existing control means is inventively utilized to be able to apply the above-described method for assuring a uniform print quality given multiple inking ribbon passage even in unmelted imprint areas.

In the version shown in FIG. 1*a*, the second thermal transfer printing head 70 (which as noted above is an added expense) is replaced in a suitable way by a non-printing heat-emitting means. This heat-emitting means may be a separate heat-emitter 60, or may be achieved by heating the roller 90. In a further version, the heat-emitting means 60 or 90 that redistributes the ink of the uppermost layer from unused or less used regions to the more highly used regions of the multi-use inking ribbon 29, is turned off by the microprocessor of the controller and/or pivoted away with a suitable lever apparatus when a distribution of the ink of the uppermost layer is undesired. This is the case when a marking with flexible coding that should still be detectable after the cassette is reversed is applied with the first thermal transfer printing head in the above-recited way. The microprocessor of the controller is therefore programmed to drive the heat-emitting means 60 or 90 such that they contribute to the formation of a marking.

FIG. 1*b* shows the basic structure of a multi-use inking ribbon cassette with alternative memory means arranged in the cassette housing. In this further version, the multi-use inking ribbon cassette 20 has a memory unit 24 and the second thermal transfer printing head 70 is replaced by a heat-emitting means 60 or 90. In this combined version with a marking printed by the manufacturer as a first information symbol relating to the piracy protection on the multi-use inking ribbon 29 and a mechanical storage of the second, usage history information in the cassette but not on the ribbon, it continues to be possible to redistribute the ink of the uppermost layer from unused or less used regions to the more heavily used regions with the heat-emitting means 60 or 90. The heat-emitter 60 may be a linolite lamp suitable for intensified heat emission that melts the uppermost layer. The inking ribbon is ironed smooth and the ink approximately uniformly distributed by the following roller 90. It is also possible to heat the roller 90.

Before the cassette is reversed, the information about the multi-use status (usage history) is stored in the memory unit 24, identifying how often this inking ribbon direction was already used.

The memory unit 24 is preferably fashioned as a mechanical memory means, however, the memory unit 24 can likewise be an optical, magnetic or electronic memory unit of the cassette.

Figure 2:
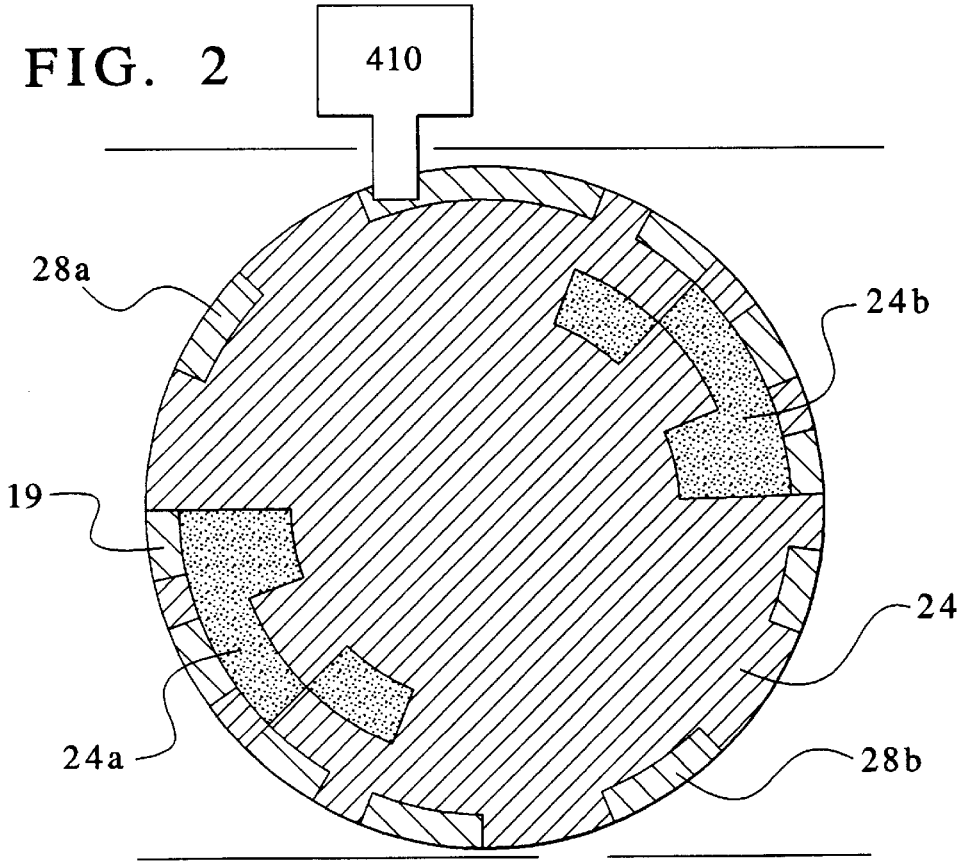
FIG. 2 shows an example of a memory for an inventive multi-use inking ribbon cassette.

A removal of the cassette without loss of the multi-use status information is possible at any time due to the memory unit 24 fashioned, for example, as a coding disk with display elements or symbols 28. Through a window 27, the display elements indicate to the user when, erroneously, the cassette is re-inserted oppositely to its proper position after having been removed in the meantime. The display element 28 can be recessed and elevations and can themselves prevent incorrect re-insertion of the cassette as long as the inking ribbon is not completely unwound to its end. For example, an arbor or a mechanical detector 410 that triggers an acoustic or optical signal can engage into the recesses (FIGS. 2 and 3*a*).

A latch element 34 can also be provided that reassumes a new latched position upon every removal. For example, the latch element 34 can have a planar form with a detent for engaging the display element 28 and a shaft, the coding disk 24 being rotatably clamped between this latch 34 and the cassette housing.

FIG. 1*c* shows a further version of a multi-use inking ribbon cassette. Further, resiliently seated deflection rollers are arranged in this cassette. The inking ribbon thereby runs from the reel 26 (or reel 25) over rollers 31*a* and 32*a* (or 31*b* and 32*b*) and between print head 1 and the recording medium 2 over rollers 31*b* and 32*b* (or, 31*a* and 32*a*) to the reel 25 (or 26). The recording medium 2 is pressed against the inking ribbon 29 with a counter-pressure roller (not shown).

Figure 3A:
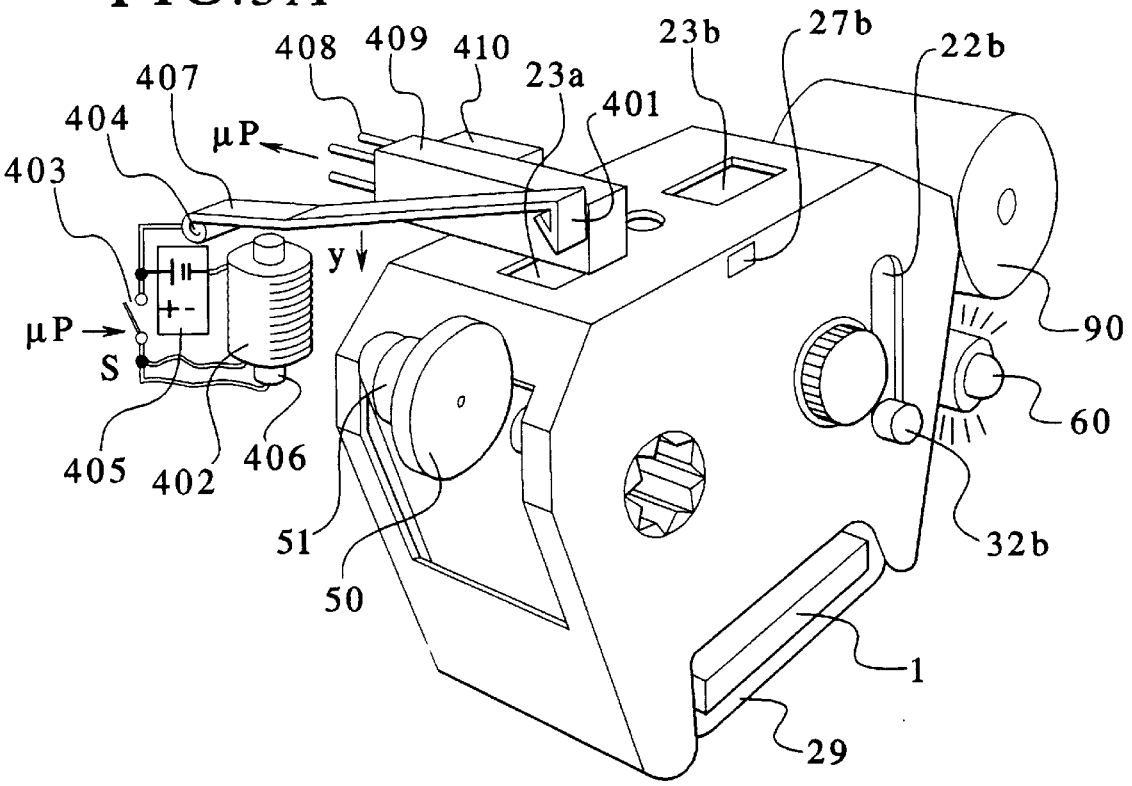
FIG. 3*a* shows an arrangement of an inventive multi-use inking ribbon cassette in a front perspective view.
Figure 3B:
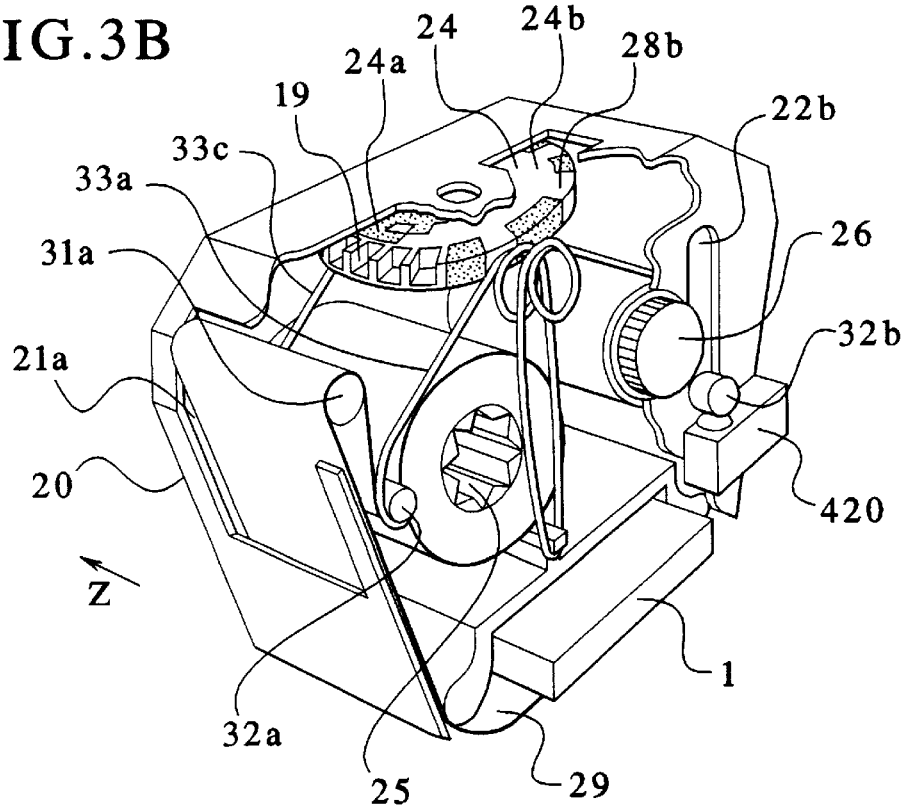
FIG. 3*b* shows an arrangement of an inventive multi-use inking ribbon cassette in a rear perspective view partly broken away.

The resiliently seated deflection rollers 32*a* and 32*b* each have a projection running in a slot in a wall of the cassette housing 20 (one of which, slot 22*b*, is shown in FIGS. 3*a* and 3*b*). The first mechanical recognition unit 420 is arranged in the cassette compartment at the back side such that, when the cassette is properly inserted, the rim of deflection roller 32*a* or 32*b* is seated against the first mechanical recognition unit 420.

FIG. 2 shows a mechanical memory unit for a multi-use inking ribbon cassette. The mechanical memory unit 24 is again fashioned as a coding disk for storing multi-use status and ribbon-travel direction information.

When the end of the inking ribbon is reached, the latch detent (which may be biased) is lowered over the adjustment rim into an opening 19. Upon removal of the cassette, the coding disk is rotated by one latch position. As a result:

a) the coding 24 for the degree of usage is incremented;

b) the side window display of the cassette is changed;

c) the coding 28*b* for the proper insertion of the cassette is incremented;

d) the bias of the latch detent is canceled.

The cassette can now only be used after removal, so that the ribbon is rewound. The status of the coding disk 24 does not change given interim removal of the cassette.

FIG. 3*a* shows a front view of an arrangement of the multi-use inking ribbon cassette, according to the schematic illustration in FIG. 1*c*, in a cassette compartment.

After the recognition of the approaching ribbon end, the microprocessor actuates a switch (S) 403 that closes a circuit formed by a voltage source 405 and a magnetic coil 402, thereby closing a switch that is arranged in parallel composed of core contact 406 and armature contact 407. Even when the switch 403 is opened, this circuit continues to be complete (self-holding). A solenoid, composed of the magnetic coil 402 and an iron core 406, is provided for actuating a lever seated at a pivot point 404. This lever has a ferromagnetic region which is attracted by the iron core 46 when the coil 42 is energized. An actuation element 401 of the lever then enters into engagement with a depression 19 in the memory unit 24. Upon removal of the multi-use inking ribbon cassette, the status of the memory unit 24 is thus caused to change.

After the re-insertion of the cassette, the information of the memory unit 24 is optically or mechanically read with the recognition unit 409.

FIG. 3*b* shows the arrangement of the multi-use inking ribbon cassette in a view from the back. A further recognition unit is in engagement with a rim of the deflection roller 32*b*. When the end of the inking ribbon is reached, the ribbon is stretched opposite the spring action of the spring 33*b* and recognition by, preferably, a microswitch is thus enabled.

Although modifications and changes may be suggested by those skilled in the art, it is the intention of the inventors to embody within the patent warranted hereon all changes and modifications as reasonably and properly come within the scope of their contribution to the art.

We claim as our invention:

1. In a thermal transfer franking printer having a thermal print head with a plurality of thermal print elements, operated by power electronics and controlled by a control unit to generate respective franking imprints of equal size on a medium by thermally transferring ink from an inking ribbon to the medium by energization of selected print elements by said control unit and thereupon also leaving respective imprints on said inking ribbon, said inking ribbon being contained in a cassette which is releasably engageable with said thermal print head and said inking ribbon being unwound from a supply reel in said cassette and wound, after printing a franking imprint, being wound onto a take-up reel in said cassette, the improvement of an arrangement for identifying an end of said inking ribbon, comprising:

an encoder disposed to measure passage of said inking ribbon which emits an electrical signal indicating a length of said inking ribbon which has passed said encoder;

a counter, disposed remote from said thermal print head and which receives said electrical signal directly from said encoder independently of said cassette, which counts a number of said franking imprints of equal size produced on said inking ribbon by said thermal print head as indicated by said electrical signal, and which emits a signal indicating an end of said inking ribbon after a predetermined number of said franking imprints of equal size on said inking ribbon.

2. In a thermal transfer franking printer having a thermal print head with a plurality of thermal print elements, operated by power electronics and controlled by a control unit to generate respective franking imprints on a medium by thermally transferring ink from an inking ribbon to the medium by energization of selected print elements by said control unit and thereupon also leaving respective imprints on said inking ribbon, said inking ribbon being contained in a cassette which is releasably engageable with said thermal print head and said inking ribbon being unwound from a supply reel in said cassette and wound, after printing a franking imprint, being wound onto a take-up reel in said cassette, a method for identifying an end of said inking ribbon comprising the steps of:

measuring passage of said inking ribbon with an encoder to detect a length of said inking ribbon which has passed said encoder said inking ribbon;

emitting an electrical signal from said encoder, indicating said length;

supplying said electrical signal directly from said encoder, independently of said cassette, to a counter disposed remote from said thermal print head;

counting in said counter a number of said franking imprints of equal size produced by said inking ribbon as indicated by said electrical signal; and emitting a signal from said counter identifying an end of said inking ribbon after a predetermined number of said franking imprints of equal size are counted.

* * * * *

UNITED STATES PATENT AND TRADEMARK OFFICE

CERTIFICATE OF CORRECTION

PATENT NO. : 6,141,029
DATED : October 31, 2000
INVENTOR(S) : Stephan Gunther and Wolfgang Thiel It is certified that error appears in the above-identified patent and that said Letters Patent is hereby corrected as shown below:

Title page

After "Assignee:" cancel "Francotypo-Postalia AG & Co." and substitute -- Francotyp-Postalia AG & Co. -- therefor.

Signed and Sealed this

Eleventh Day of September, 2001

*Attest:*

Nicholas P. Godici

*Attesting Officer*

NICHOLAS P. GODICI
*Acting Director of the United States Patent and Trademark Office*